US009212823B2

(12) United States Patent
Boardman et al.

(10) Patent No.: US 9,212,823 B2
(45) Date of Patent: Dec. 15, 2015

(54) SYSTEMS AND METHODS FOR SUPPRESSING COMBUSTION DRIVEN PRESSURE FLUCTUATIONS WITH A PREMIX COMBUSTOR HAVING MULTIPLE PREMIX TIMES

(75) Inventors: Gregory Allen Boardman, Greer, SC (US); Ronald James Chila, Greenfield Center, NY (US); Mark Allan Hadley, Greer, SC (US); Johnie Franklin McConnaughhay, Greenville, SC (US); Sarah Lori Crothers, Greenville, SC (US)

(73) Assignee: General Electric Company, Schenectady, NY (US)

( * ) Notice: Subject to any disclaimer, the term of this patent is extended or adjusted under 35 U.S.C. 154(b) by 471 days.

(21) Appl. No.: 13/604,952

(22) Filed: Sep. 6, 2012

(65) Prior Publication Data

US 2014/0060063 A1 Mar. 6, 2014

(51) Int. Cl.
*F23R 3/28* (2006.01)

(52) U.S. Cl.
CPC ..... *F23R 3/286* (2013.01); *F23R 2900/00014* (2013.01); *F23R 2900/03043* (2013.01); *F23R 2900/03045* (2013.01)

(58) Field of Classification Search
CPC ..... F23R 3/286; F23R 2900/03043; F23R 2900/03045
See application file for complete search history.

(56) References Cited

U.S. PATENT DOCUMENTS

| | | | | |
|---|---|---|---|---|
| 3,736,747 | A * | 6/1973 | Warren | F23R 3/002 60/730 |
| 4,790,140 | A * | 12/1988 | Sato | F23R 3/002 60/757 |
| 5,450,725 | A * | 9/1995 | Takahara et al. | 60/737 |
| 5,644,918 | A | 7/1997 | Gulati et al. | |
| 6,381,964 | B1 | 5/2002 | Pritchard et al. | |
| 6,442,940 | B1 | 9/2002 | Young et al. | |
| 6,935,116 | B2 | 8/2005 | Stuttaford | |
| 6,959,550 | B2 | 11/2005 | Freeman | |
| 2005/0044857 | A1 * | 3/2005 | Glezer et al. | 60/772 |
| 2009/0094985 | A1 * | 4/2009 | Johnson et al. | 60/752 |
| 2009/0223225 | A1 * | 9/2009 | Kraemer et al. | 60/723 |
| 2009/0252593 | A1 * | 10/2009 | Chila | F01D 9/023 415/58.4 |
| 2010/0043448 | A1 | 2/2010 | Lohmueller | |
| 2010/0223930 | A1 * | 9/2010 | Chila | 60/752 |
| 2011/0239654 | A1 * | 10/2011 | Bland | F23R 3/002 60/752 |
| 2011/0247341 | A1 * | 10/2011 | McMahan | F23M 5/085 60/757 |

OTHER PUBLICATIONS

Lieuwen, "Combustion Driven Oscillations in Gas Turbines", Turbomachinery International, Jan./Feb. 2003, www.turbomachinerymag.com.

* cited by examiner

*Primary Examiner* — Gerald L Sung
*Assistant Examiner* — Scott Walthour
(74) *Attorney, Agent, or Firm* — Ernest G. Cusick; Frank A. Landgraff

(57) ABSTRACT

A combustor having a combustion chamber is provided with an external flow sleeve and a combustor liner surrounding the combustion chamber. A plurality of flow channels are provided on the combustor liner and a plurality of nozzles are disposed at predetermined locations on the flow channels. The locations of the nozzles are selected to provide different mixing times for fuel injected through the nozzles.

17 Claims, 8 Drawing Sheets

SYSTEMS AND METHODS FOR SUPPRESSING COMBUSTION DRIVEN PRESSURE FLUCTUATIONS WITH A PREMIX COMBUSTOR HAVING MULTIPLE PREMIX TIMES

TECHNICAL FIELD

The subject matter disclosed herein relates generally to gas turbine combustors and more particularly to a premix combustor having multiple premix times.

BACKGROUND

Gas turbines utilize a compressor for compressing air which is mixed with a fuel and channeled to a combustor. The mixture is ignited within a combustion chamber in the combustor from which hot combustion gases are generated. The combustion gases are conveyed to a turbine, which extracts energy from the combustion gases for powering the compressor, as well as producing useful work to power a load, such as an electrical generator.

Conventional combustors typically include a combustor casing, a liner, a dome, a fuel injector, and an igniter. The combustor casing operates as a pressure vessel containing the high pressure inside the combustor. The liner encapsulates a combustion zone and may be used to manage various airflows into the combustion zone. The dome is the component through which the primary air flows as it enters the combustion zone. A swirler may be used in association with the dome. The dome and swirler provide the function of generating turbulence in the flow to mix the air and fuel. The swirler may create turbulence by forcing some of the combustion products to recirculate.

Combustors are designed to first mix and ignite the air or an oxidizing fluid and fuel, and then mix in more air to complete the combustion process. The oxidizing fluid may be an oxidizer such as air, or a mixture of an oxidizer and a diluent such as water, steam, Nitrogen or other inert substance used to dilute the oxidizer. Design criteria for combustors include a number of factors, such as containment of the flame, uniform exit temperature profiles, range of operations and environmental emissions. These factors affect turbine reliability and power plant economics.

During the operation of a gas turbine combustor, instabilities may occur when one or more acoustic modes of the system are excited by the combustion process. The excited acoustic modes may result in periodic oscillations of system properties (e.g., velocity, temperature and pressure) and processes (e.g., reaction rate or heat transfer rate).

Combustion instabilities may result from flame sensitivity to acoustic perturbations. The perturbations disturb the flame, causing heat release fluctuations which in turn generate acoustic waves that reflect off combustor surfaces and re-impinge upon the flame, causing additional heat release oscillations. In some situations a self-exciting feedback cycle may be created. This feedback cycle results in oscillations with large amplitudes.

Another source of combustion instabilities may be oscillations in the fuel/air ratio in premixed combustors. Pressure fluctuations in the premixer may cause an oscillating pressure drop across the fuel injectors, resulting in an oscillatory delivery of fuel to the combustor. These create further flow and pressure disturbances in a feedback loop. This mechanism may be self-exciting when the product of the frequency of oscillation, f, and the delay between the time a fuel parcel is injected into the premixer and burned at the flame (premix time or Tau), are within a range of values. Tau is a function of the air velocity in the premixer and the premixer length.

Combustion driven oscillations negatively impact the life of gas turbine components which may result in more frequent outages and the de-rating of turbine power output. Additionally, combustion driven oscillations may also result in an increase of pollutant emissions (e.g. NOx and CO). Conventional combustors exhibit damaging combustion driven oscillations within their operating range and are sensitive to fuel-injection pressure ratio (modified Wobbe), combustor loading and inlet conditions.

BRIEF DESCRIPTION OF THE INVENTION

In accordance with one exemplary non-limiting embodiment, the invention relates to a combustor having a combustion chamber with a longitudinal axis; an external flow sleeve; and a combustor liner surrounding the combustion chamber and coupled to the external flow sleeve. The combustor liner includes a plurality of flow channels. The combustor also includes a plurality of nozzles. At least some of the plurality of flow channels have at least one of the plurality of nozzles disposed at predetermined locations. The predetermined locations are selected to provide different flow path lengths between some of the plurality of nozzles and the combustion chamber.

In another embodiment, a gas turbine with a combustor is provided. The combustor includes a combustion chamber having a longitudinal axis; an external flow sleeve; and a combustor liner surrounding the combustion chamber and coupled to the external flow sleeve. The combustor liner and the external flow sleeve form a plurality of flow channels. A plurality of nozzles are provided. At least some of the plurality of flow channels have at least one of the plurality of nozzles disposed to provide different flow path lengths between some of the plurality of nozzles and the combustion chamber.

In another embodiment, a method of suppressing combustor dynamics is provided. The method includes providing oxidizing fluid to a plurality of channels formed on a combustor liner. The method also includes injecting a fuel into at least some of the plurality of channels to generate a plurality of streams of fuel and oxidizing fluid, the fuel being injected at predetermined locations to provide different flow path lengths between the predetermined locations and a combustion chamber. The method also includes combusting each of the plurality of streams of fuel and oxidizing fluid in the combustion chamber.

In another embodiment, a liner for a combustor, including an assembly having a plurality of flow channels, is disposed in the combustor between a combustion chamber and a sleeve.

Other features and advantages of the present invention will be apparent from the following more detailed description of the preferred embodiment, taken in conjunction with the accompanying drawings which illustrate, by way of example, the principles of certain aspects of the invention.

DETAILED DESCRIPTION OF THE INVENTION

Figure 1:
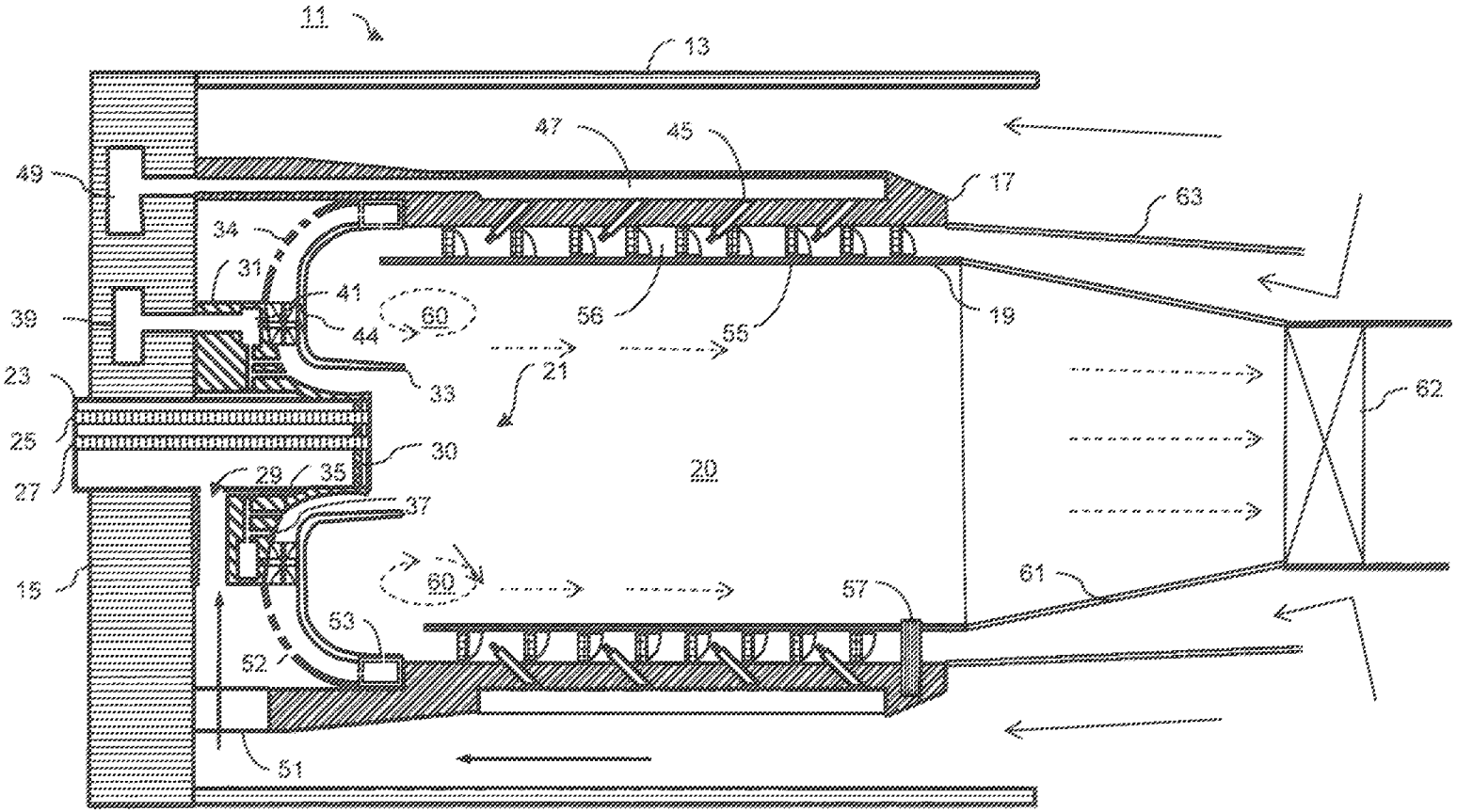
FIG. 1 is a cross-section across the longitudinal axis of an embodiment of a multiple Tau combustor.

Illustrated in FIG. 1 is a multiple Tau combustor 11 including a combustor casing 13, and an end cover assembly 15. Disposed within the combustor casing 13 is a flow sleeve 17 which may be substantially cylindrical. Inserted within the flow sleeve 17 is a finned liner 19 described in more detail below. Together, the finned liner 19 and end cover assembly 15 define a combustion chamber 20.

Adjacent to the end cover assembly 15 is a dome assembly 21. Dome assembly 21 may include a center body cartridge 23 disposed through the end cover assembly 15. The centerbody cartridge 23 is hollow and may include one or more sensors 25 and other centerbody components 27 (for example an igniter, a torch, a liquid fuel pilot, a small high-frequency (HF) resonator, or various feedback sensors). Specific options can be selected that best support a particular mission or product configuration—e.g., gas only or dual fuel. The centerbody cartridge 23 includes an opening 29 that allows an oxidizing fluid to enter the interior of the centerbody cartridge 23. The oxidizing fluid may be an oxidizer, such as air, or a mixture of an oxidizer and a diluent such as water, steam, Nitrogen or other inert substance used to dilute the oxidizer. A perforated plate 30 may be disposed in the centerbody cartridge to support the sensors 25 and centerbody components 27 and to provide cooling for the sensor 25 and centerbody components 27.

The dome assembly 21 also may include a center nozzle assembly 31 that may be a frustoconical member with a concave surface. Surrounding the center nozzle assembly are a first exterior dome element 33 and a second exterior dome element 34 which may be hemi-toroidal in shape. The center nozzle assembly 31 may have one or more primary injection channels, e.g. primary injection channels 35 and 37, which may be of different lengths. The center nozzle assembly 31 is supplied with fuel from primary fuel source 39 through the end cover assembly 15 and into a primary nozzle manifold 41. A swirler 43 may be provided with the dome assembly 21. The dome assembly 21 and swirler 43 generate turbulence in the flow to rapidly mix the oxidizing fluid with the fuel. The swirler 43 forces some of the combustion products to recirculate, creating high turbulence. In one embodiment, the majority of oxidizing fluid flows radially to the center nozzle assembly 31. Swirler 43 imparts the flow with some swirl (tangential velocity) using vanes or slots (not shown). The swirl angle (angle of the vanes or slots) imparted to the oxidizing fluid flow through the center-nozzle assembly 31 may be between about −60° and +60°, where a negative value would be counter to the main, dump swirling flow (0° would be no swirl). In one embodiment the exiting swirl may be at about +45°. Fuel may be injected into the oxidizing fluid flow before, during, and after the swirl is imparted. The dome assembly 21 may be provided with a plurality of effusion cooling holes 44. Effusion cooling holes 44 provide a layer of cooling fluid to the inner surfaces of the combustion chamber 20.

A plurality (at least two) nozzles such as injectors 45 may be disposed on flow sleeve 17 coupled to an injector fuel manifold 47 on the flow sleeve 17. The injector fuel manifold 47 is supplied with fuel from an injector fuel source 49 conveyed through the end cover assembly 15. In one embodiment, the injector fuel source 49 may be a ring formed in the end cover assembly 15 having a plurality of injector fuel manifolds 47 on the flow sleeve 17. An opening 51 may be formed on the flow sleeve 17 to provide oxidizing fluid to the centerbody cartridge 23. In one embodiment, more than one opening 51 may be provided. A resonator (damper) 53 may be disposed adjacent to the flow sleeve 17 between first exterior dome element 33 and second exterior dome element 34. The resonator 53 may be annular in shape, with or without baffles or other form of volume separator. The dome assembly 21 and the finned liner 19 define a primary dump zone 60 where the fuel and oxidizing fluid mixture from the flow channels 56 is conveyed and mixed. The resonator 53 may be purged by cooling fluid (typically the oxidizing fluid) provided to the dome assembly 21 at a specific location relative to the primary dump zone 60.

The dimensions of the first exterior dome element 33 and the centerbody cartridge 23 may vary depending on the desired results. For example, a first exterior dome element 33 and centerbody cartridge 23 that are longer would provide a longer average premix time (average Tau). A first exterior dome element 33 and centerbody cartridge 23 that are longer would also provide greater independence from the oxidizing fluid and fuel mixture provided through the flow sleeve 17. A first exterior dome element 33 that is shorter would have less material to cool and would provide a shorter average premix time. In one embodiment the first exterior dome element 33 terminates close to the primary dump zone 60.

Figure 2:
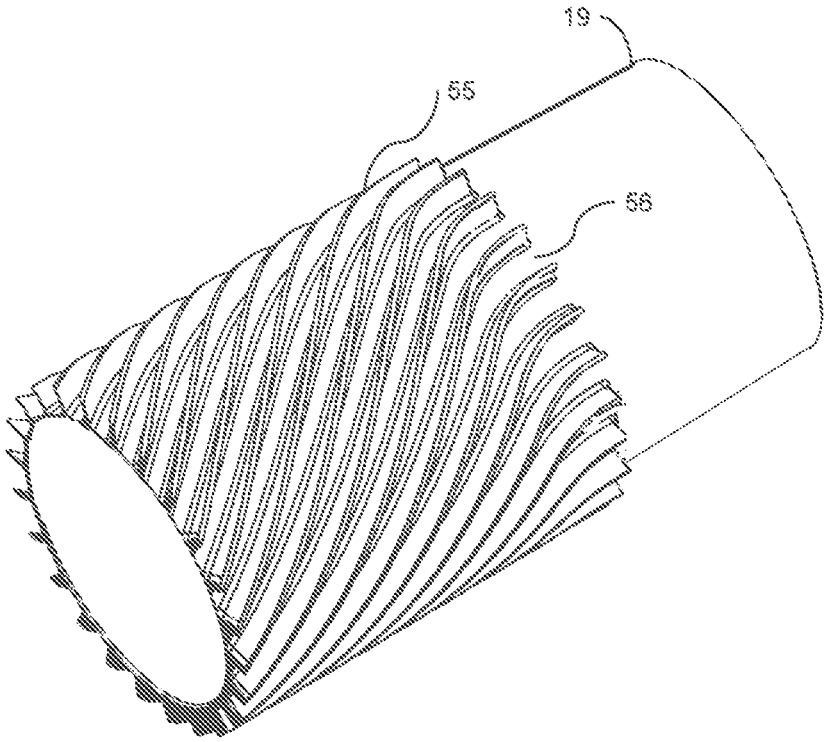
FIG. 2 is an illustration of a finned liner used in a multiple Tau combustor.

The finned liner 19 (also illustrated in FIG. 2) may be provided with a plurality of fins 55 that define a plurality of flow channels 56. In one embodiment, the fins 55 may be helical and evenly spaced. The finned liner 19 and the flow sleeve 17 create an array of individual, flow channels 56 having a helical geometry (helical flow channels). The finned liner 19 may be secured to the flow sleeve 17 by suitable attachment means such as a pin 57.

Although in the preceding embodiment fins 55 are illustrated as helical fins, other geometric configurations are contemplated, and may include flow channels 56 configured as straight channels, labyrinths channels, and the like.

The multiple Tau combustor 11 is provided with a liner extension or transition piece 61 that conveys high pressure combustion exhaust (shown as dashed arrows) to a turbine 62. An annular sleeve 63 may be provided to direct compressor discharge fluid (shown as solid arrows) to cool the transition piece 61 and direct the oxidizing fluid into the flow channels 56.

During the operation of the multiple Tau combustor 11, compressed oxidizing fluid from a compressor (not shown) is conveyed between the combustor casing 13 and the flow sleeve 17 through an opening 51. A first portion of the oxidizing fluid is conveyed past a plurality of impingement holes 52 formed on the second exterior dome element 34 and is used to cool the dome assembly 21. A second portion of the oxidizing fluid is conveyed to the centerbody cartridge 23. Some of the first portion of the oxidizing fluid is conveyed to the resonator 53 and serves to purge the resonator 53. The rest of the first portion of the oxidizing fluid feeds the swirler 43 of the center nozzle assembly 31.

Fuel from primary fuel source 39 flows into the center nozzle assembly 31 and is injected into the combustion chamber 20 through primary injection channels 35 and 37. As is illustrated in FIG. 1, the primary injection channels 35 and 37 are disposed at different locations along the radius of the primary nozzle manifold 41 thereby, providing different premixing time for the oxidizing fluid and fuel mixture.

Fuel from injector fuel source 49 is conveyed to the injector fuel manifold 47 through the plurality of injectors 45 and into the flow channels 56 formed in the finned liner 19. The fuel mixes with the oxidizing fluid and generates an oxidizing fluid and fuel mixture stream. The finned design allows for per-channel, independent air and fuel mixture streams. Each of the plurality of injectors 45 is disposed at a predetermined location on a corresponding flow channel 56. The locations of the injectors 45 are selected to provide a different premixing time for at least some of the plurality of streams of air and fuel mixture and to promote mixing over a substantial path-length distance (e.g., from 5 to 40 inches). In this embodiment, the flow channels 56 all have the same inlet plane and exit dump plane. The location of the injectors 45 where the fuel is injected along the path of the flow channels 56 determines the flow path lengths between the injectors 45 and the combustion chamber 20. The flow path length determines the premixing time (Tau) defined as the time from where the fuel is injected in the premixer to where it burns in the multiple Tau combustor 11.

In one embodiment, each flow channel 56 may have its own specific premixing time (Tau)—so, for example, a multiple Tau combustor 11 with twenty-four vanes may have twenty-four (or more) different Taus spread over a relatively large range (e.g., 3 to 15 msec). The smallest Tau would be limited by premixing quality, while the largest Tau might be limited by auto-ignition time (fuel specific), or an envelope size constraint. Within a given flow channel 56 at a location corresponding to a specific Tau, the gas fuel is injected into the flow channel 56 with one or more injectors 45 from the inner wall of the flow sleeve 17. The injectors 45 may be cantilevered radially inward (at a compound angle) from the wall of the flow sleeve 17 into the flow channel 56, while in communication with a specific fuel plenum cavity (e.g. injector fuel source) 49. The injectors 45 may be airfoils with a plurality of injection holes, multiple tapered tubes projecting into the channel, or multiple plain wall orifices. In one embodiment, the fuel injectors 45 would not be structurally attached to the finned liner 19, or to the fins 55. However, the finned liner 19 would be structurally pinned to the flow sleeve 17 at multiple locations near the aft end.

The finned liner 19 provides the additional functionality of enhancing the cooling capability by increasing the heat transfer cooling area (fin cooling) and by continuously accelerating the cooling flow in the flow channels 56. Greater heat-transfer area (cold side), and/or greater flow acceleration, means greater cooling of the finned liner 19, and, thus, lower temperatures for a given heat flux.

In one embodiment, the fins 55 convert a portion of the purely axial annular-duct flow (in the forward direction, toward the end cover assembly 15 or headend) to helical flow—so that the flow exits the flow channels 56 into the primary dump zone 60 with a swirl component. The helical pitch is a design parameter that can be varied to change the overall mixing length or exiting swirl strength. In general the helical pitch could be set so that the exiting flow was turned (swirl velocity component) anywhere from 0° (no swirl) to about 65° (very high swirl) with respect to the combustor's axis of symmetry. In this embodiment, the pitch is set so that the exiting flow is turned between approximately 35° and 55° (45° nominally). Also, in another embodiment, the helical pitch could be varied along the length of the finned liner 19 to affect Tau values and/or mixing quality along the premixing path.

At the exit of the flow channels 56, the swirling flow dumps into the primary dump zone 60 formed by the dome assembly 21 that forces the flow to accelerate radially inward. The strong inward acceleration of the swirling flow further mixes the reactants and prepares the flow for expansion and a strong, stable toroidal recirculation. The combustion area of the combustion chamber 20 is further stabilized by the independent fueling of the center nozzle assembly 31 that meshes with and pilots the main reaction.

Most of the leftover air, i.e., the combustion air that bypasses the flow channels 56, is used to cool the dome assembly 21 (via impingement and effusion cooling), premix and burn with fuel from the primary fuel source 39 using the center nozzle assembly 31, purge the cavities of the resonator 53, aid liquid-fuel atomization, and/or cool the centerbody cartridge 23 and sensor 25 and centerbody components 27. Over three quarters of the "bypass air" impingement cools the dome assembly 21 first before it is used for effusion cooling, purging, and premixing in the center nozzle assembly 31.

The center nozzle assembly 31 collects spent dome-cooling impingement air (which is between 15 and 20% of the combustion air) and swirls it, while injecting and mixing gas fuel into it. The swirling reactants expand into the multiple Tau combustor 11 creating a stable, central recirculation zone. The center nozzle assembly 31 is provided with fuel from the primary fuel source 39 and is primarily relied on for ignition, acceleration, and low-load operation. At ignition, the multiple Tau combustor 11 may be designed to have close to 100% of the total fuel flow of the multiple Tau combustor 11. Near base load (while in NOx emissions compliance), the fuel flow will be less than ~15%. The center nozzle assembly 31 gives the multiple Tau combustor 11 flexibility to cover the complete speed-load space.

Figure 3:
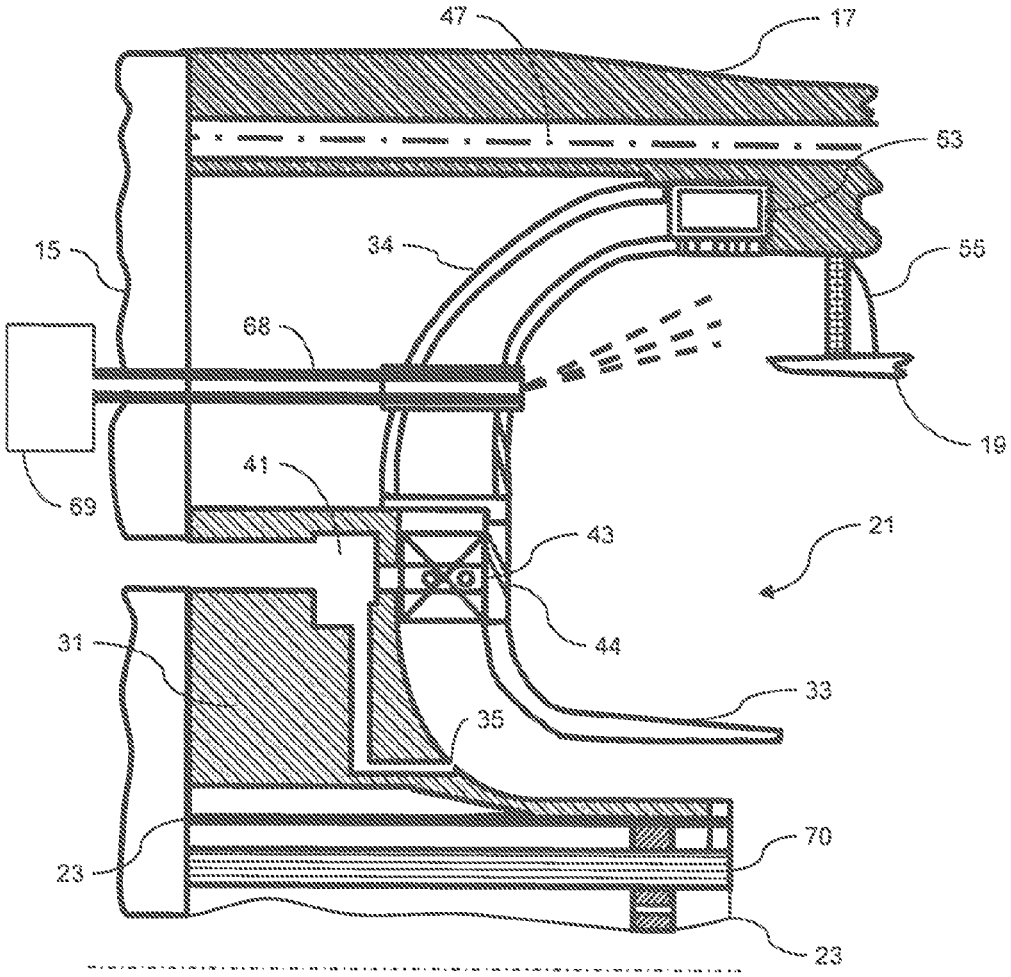
FIG. 3 is a cross section across the longitudinal axis of an embodiment of the multiple Tau combustor.

FIG. 3 illustrates a multiple Tau combustor 11 adapted for liquid fuel operation and shows a section of the dome assembly 21 with a liquid-fuel injector 68 for a dual-fuel-option embodiment. For liquid-fuel operation, one or more liquid fuel injector(s) 68 may be disposed adjacent to the dome assembly 21, injecting liquid fuel away from the dome assembly 21 and into the forward-flowing (toward the dome assembly 21) helical-swirling air streams as they enter into the primary dump zone 60. The liquid fuel injector(s) 68 may be any one of a number of different atomizer types to inject the liquid—e.g., plain jet, jet swirl, fan spray, simplex, prefilm airblast, etc. Like the gas-fuel scenario, the liquid-fuel injector(s) 68 may be grouped together into subgroups and supplied by one or more main-liquid fuel circuits in various configurations. In one embodiment, eight liquid fuel injectors 68 (breech loaded through the end cover assembly 15) may be supplied uniformly by a liquid-fuel circuit 69. An independent liquid fuel pilot 70 may be located in the centerbody cartridge 23. The liquid fuel pilot 70 may be relied on for ignition and no-load operation. The liquid fuel pilot 70 and main liquid fuel circuit 69 may be actively controlled and modulated during operation, as a function of engine speed, load or both.

Figure 4:
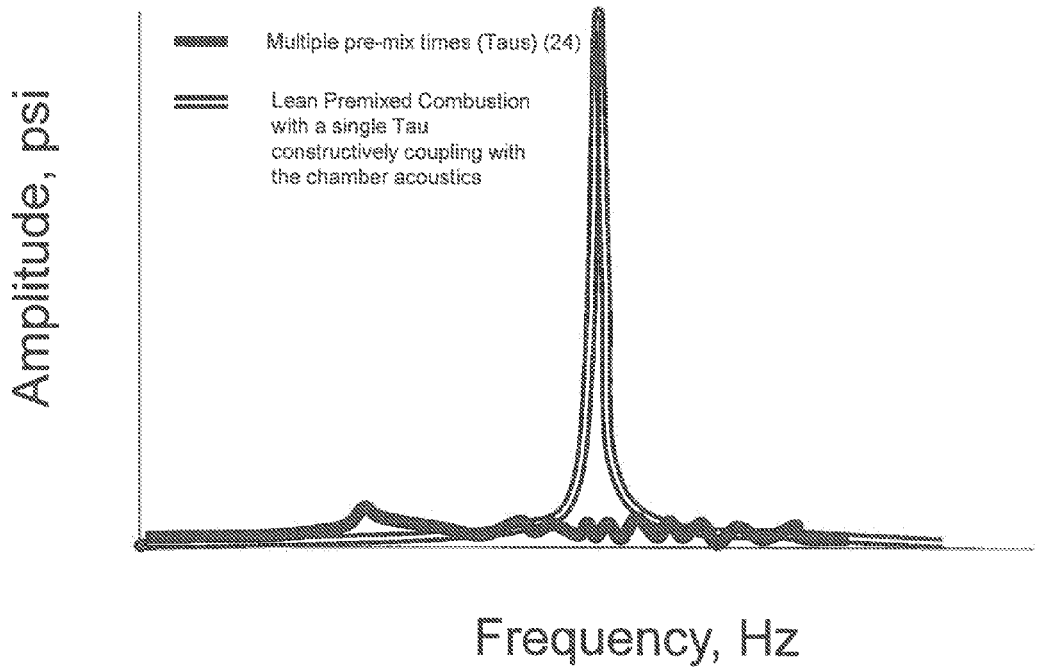
FIG. 4 is a chart illustrating the frequency and amplitude performance of an embodiment of the multiple Tau combustor.

FIG. 4 is a chart that illustrates the effect of multiple Taus on combustion driven oscillations. The chart demonstrates excitation results comparing a single Tau (for example in a 2.6+, 5-around-1 headend configuration) represented with a dual line with 24 different Taus represented by a solid line, each of the Taus evenly spaced—conservatively assuming constructive coupling for all Taus. Each Tau is inversely proportional to a particular frequency Tau $-\propto$ C/f. In the case of a single Tau, all of the fluctuation energy from all six nozzles is focused at a specific frequency (or small frequency range assuming some small minimal variation among them). With many premix times in the case of the multiple Taus, the variation in heat release (energy) is distributed across many frequencies, and no single combustor frequency is fed with enough heat-release variation to excite the oscillations appreciably. Consequently, no single frequency is allowed to dominate and the energy is spread out over many frequencies, all at low relative amplitudes. The result using multiple Taus is analogous to low amplitude, amorphous white noise.

Figure 5:
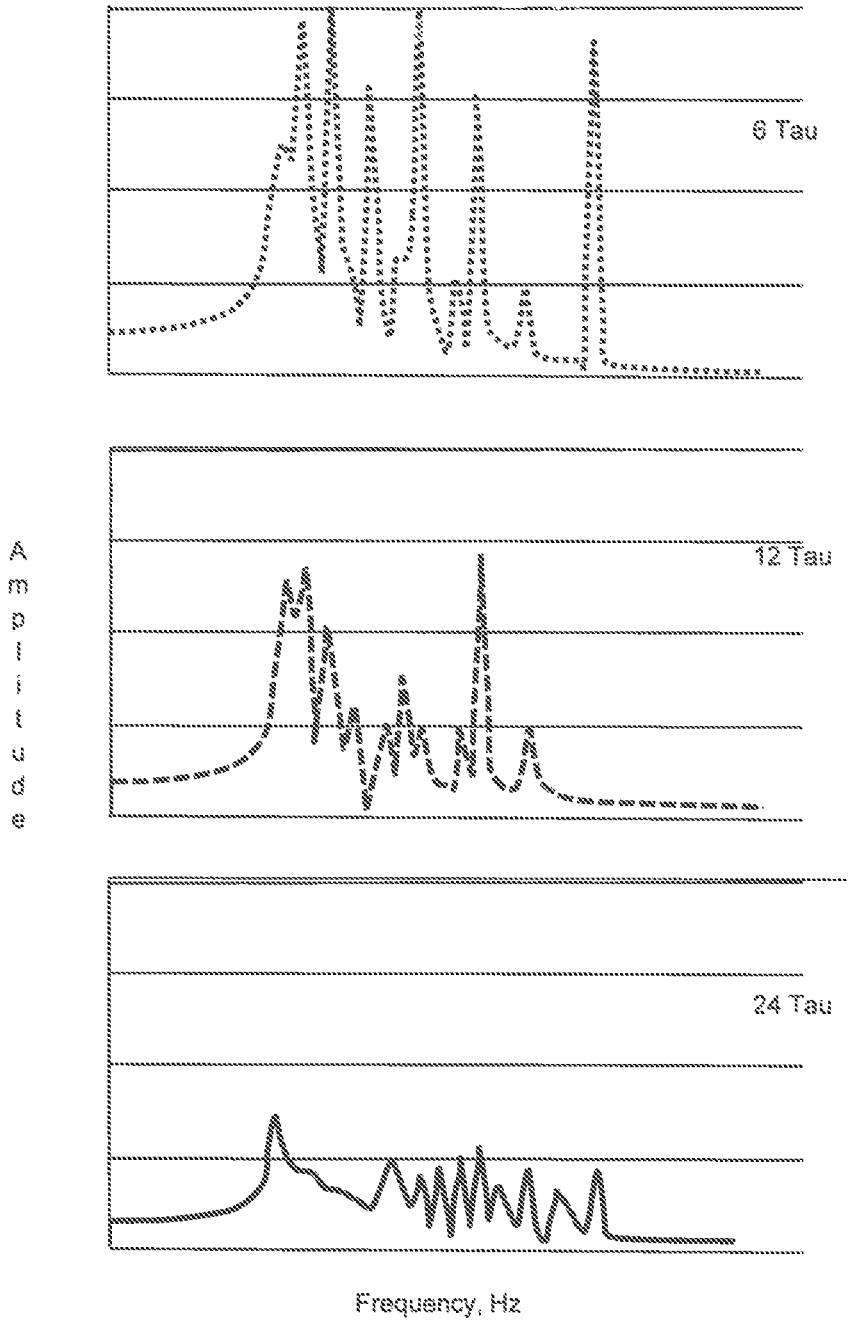
FIG. 5 is a chart illustrating the frequency and amplitude performance of different illustrative embodiments of the multiple Tau combustor.

FIG. 5 compares results for different numbers of Taus. The three graphs from top to bottom illustrate the results having six, twelve and twenty-four Taus, respectively and shows that the greater the number of individual Taus, the flatter the amplitude response. For each fuel air stream flowing through a flow channel 56, the Tau is in part a function of the location of the injector 45 for that particular flow channel 56. Spreading the heat release over many Taus is done to approach a white noise scenario, at least for moderate to lower frequencies (e.g., 80 to 1000 Hz), which are usually associated with a combustor's characteristic volumes and lengths in combination with particular thermodynamic/fluid-dynamic boundary conditions and excitation mechanisms. Any higher frequencies that persist (e.g., >1000 Hz, associated with radial or transverse modes), are damped out by resonators 53 that are strategically placed in and around the primary dump zone 60, where the mean heat release is actually occurring.

Combustion driven dynamics can be reduced when at least two flow channels 56 are provided with injectors 45 disposed in a way such as to provide at least two Taus, or alternatively when at least six flow channels 56 are provided having injectors 45 disposed in a way so as to provide at least six premix times (Taus); or alternatively when at least twelve flow channels 56 are provided with at least twelve injectors 45 disposed in a way so as to provide at least twelve premix times; or alternatively when at least a twenty four flow channels 56 are provided with at least twenty four injectors 45 disposed in a way so as to provide at least twenty four premix times. The premix times may be adjusted by placing the injectors 45 at different locations along the flow channel 56 and varying the length of the path of travel of the fuel air mixture along the flow channels 56 by varying the distance to the combustion chamber 20. The improvements are achieved by injecting fuel into an air stream at a plurality of locations to generate a plurality of streams of air fuel mixture. Each injector 45 location is selected to provide a different premix time for at least some of the streams of air fuel mixture.

Figure 6:
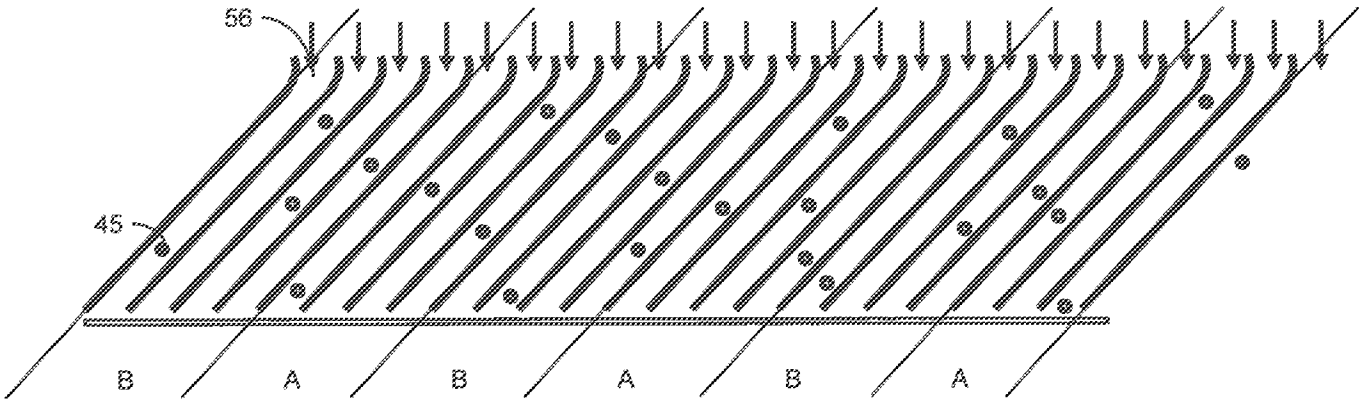
FIG. 6 is a planar mapping of a finned liner showing the location of different nozzles.

The fuel injection for the different flow channels 56 may be grouped together into various subgroups. FIG. 6 illustrates an arrangement in which twenty four (24) flow channels 56 are grouped into six (6) clusters each having four (4) flow channels 56, and each fed by an injector 45. The helical array is mapped flat to a plane for illustration purposes. Using the flow sleeve 17 and end cover assembly 15 (shown in FIG. 1) to segregate the parent fuel flow, each subgroup (child) can be fed by a specific fuel circuit (e.g., A, B, etc.). This allows for independent subgroup fuel staging. The fuel splits between circuits can be varied, or modulated, as a function of speed or load. In this embodiment, the subgroups are fed by two equally-sized premix circuits (A & B). In the example in FIG. 6, the subgroups fueled by premix circuit A and premix circuit B alternate, going around the outer circumference of the multiple Tau combustor 11. By alternating the premix circuits, three 4-channel groupings fueled by premix circuit A alternating with three 4-channel groups fueled by premix circuit B may be obtained.

Although in the embodiment illustrated in FIG. 6, twenty-four flow channels 56 grouped into six clusters are described, any combination of flow channels 56, and clusters may be used, and may, for example, have between three and thirty-six flow channels.

Figure 7:
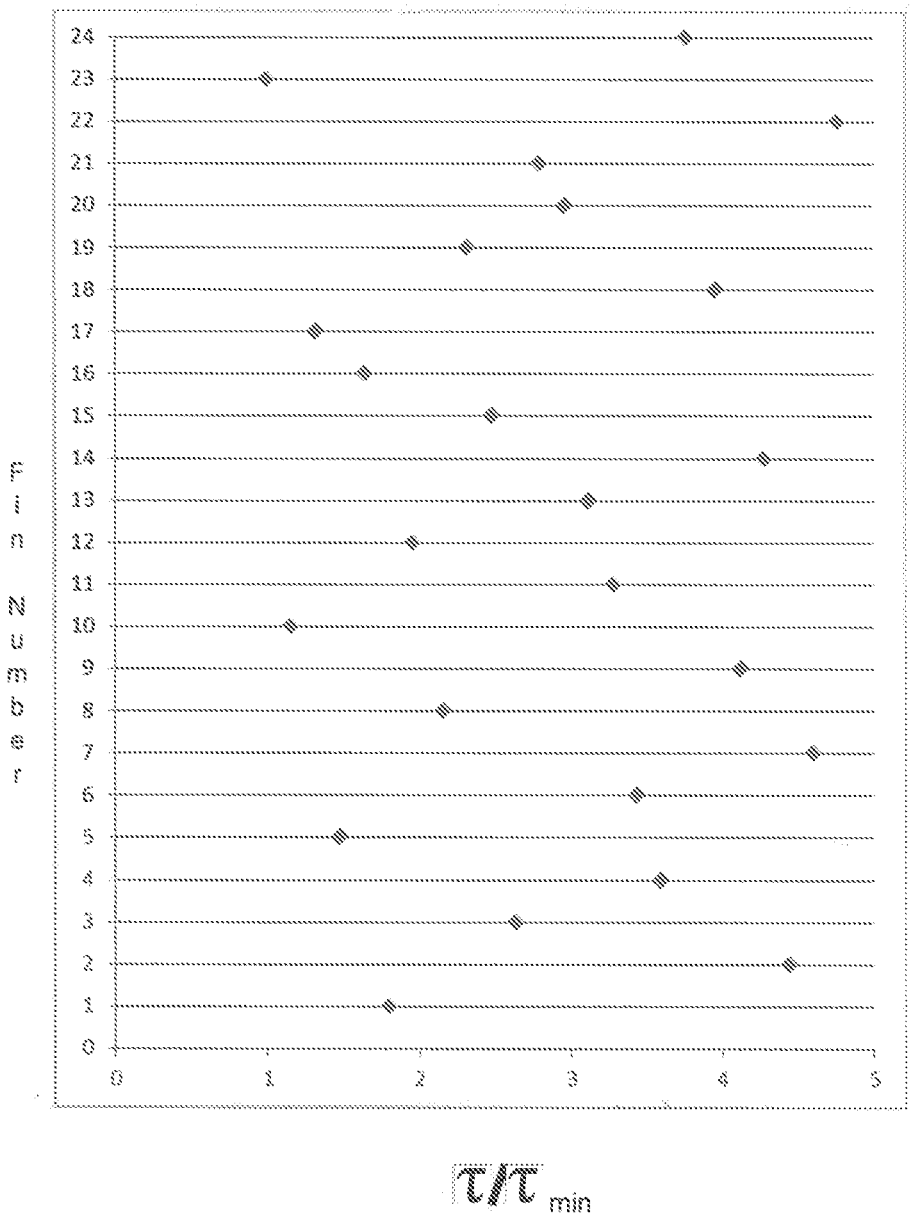
FIG. 7 is a scatter plot of the premixing time by location of the injector nozzle.

FIG. 7 illustrates an example of the distribution of premix times that may be achieved by placing the injectors 45 at different locations in the flow channels 56. The vertical axis shows a fin number which denotes the flow channel 56 and the horizontal axis denotes the Tau provided by the particular number of the flow channel 56 divided by the minimum Tau.

Figure 8:
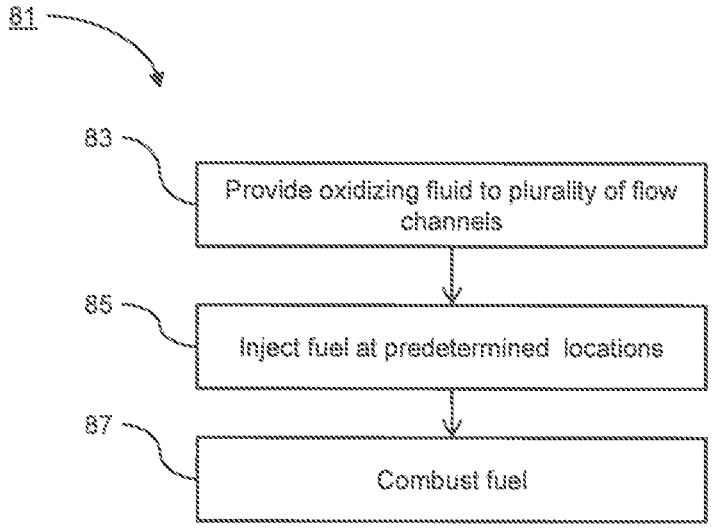
FIG. 8 is a flow chart of a method implemented by an embodiment of a multiple Tau combustor.

The various embodiments described herein provide a multiple Tau combustor 11 for a lean-premix gas-turbine designed to suppress combustion driven dynamics caused by fuel-air premixer fluctuations. FIG. 8 illustrates a method of suppressing combustor dynamics 81. In step 83, oxidizing fluid may be provided to a plurality of flow channels 56 formed on a finned liner 19. In step 85, fuel may then be injected into at least two of the plurality of flow channels 56 to generate a plurality of streams of fuel and oxidizing fluid. The fuel may be injected at predetermined locations to provide different flow path lengths between the predetermined locations and the combustion chamber 20. In step 87 the plurality of streams of fuel and oxidizing fluid may be combusted in the combustion chamber 20. Combustor dynamics may also be suppressed by injecting an oxidizing fluid and fuel mixture along the longitudinal axis of the combustion chamber 20 through a central nozzle such as center nozzle assembly 31 provided with a plurality of primary injection channels (e.g. primary injection channel 35 and primary injection channel 37) having different flow path lengths. Combustor dynamics may also be suppressed by dampening high-frequency oscillations with a resonator (damper) 53.

The multiple Tau combustor 11 is designed to stay dynamically quiet over its operating range by using a plurality of fuel-air premixing times (Taus), and resonators 53 for high-frequency damping, and a swirling-dump toroidal recirculation for stable combustion. Additionally the multiple Tau combustor 11 is substantially insensitive to fuel-injection pressure ratio (modified Wobbe), variations or cycle conditions.

The terminology used herein is for the purpose of describing particular embodiments only and is not intended to be limiting of the invention. Where the definition of terms departs from the commonly used meaning of the term, applicant intends to utilize the definitions provided below, unless specifically indicated. As used herein, the singular forms "a", "an" and "the" are intended to include the plural forms as well, unless the context clearly indicates otherwise. It will be further understood that the terms "comprises" and/ or "comprising," when used in this specification, specify the presence of stated features, integers, steps, operations, elements, and/ or components, but do not preclude the presence or addition of one or more other features, integers, steps, operations, elements, components, and/ or groups thereof. It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any, and all, combinations of one or more of the associated listed items. As used herein, the phrases "coupled to" and "coupled with" as used in the specification and the claims contemplates direct or indirect coupling.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, all of the possible iterations are not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

What is claimed:

1. A method of suppressing combustor dynamics comprising:

providing oxidizing fluid to a plurality of flow channels disposed on an outer surface of a combustor liner, wherein the plurality of flow channels are defined between respective adjacent protruding helical fins of an array of protruding helical fins, and wherein the array of protruding helical fins is integrally formed on the outer surface of the combustor liner;

providing a plurality of fuel nozzles;

injecting fuel through at least two fuel nozzles of the plurality of fuel nozzles into at least two respective flow channels of the plurality of flow channels to generate a plurality of streams of fuel and oxidizing fluid, the at least two fuel nozzles being disposed at respective predetermined axial locations within the at least two respective flow channels thereby defining at least two respective flow path lengths between each of the at least two fuel nozzles and a combustion chamber, wherein the at least two respective flow path lengths comprise at least two different flow path lengths; and combusting each of the plurality of streams of fuel and oxidizing fluid in the combustion chamber.

2. The method of claim 1 wherein injecting fuel through the at least two fuel nozzles of the plurality of fuel nozzles into the at least two respective flow channels of the plurality of flow channels comprises injecting the fuel into the oxidizing fluid provided to the plurality of flow channels.

3. The method of claim 1 further comprising injecting an oxidizing fluid and fuel mixture along a longitudinal axis of the combustion chamber through a central nozzle.

4. The method of claim 1 further comprising dampening high-frequency oscillations with a damper.

5. The method of claim 1 wherein the at least two fuel nozzles of the plurality of fuel nozzles comprises at least three fuel nozzles;

wherein the respective predetermined axial locations comprises at least three respective predetermined axial locations; and wherein the at least two respective flow path lengths comprises at least three different flow path lengths.

6. A liner for a combustor comprising:

a plurality of flow channels disposed on an outer surface of the liner, wherein the plurality of flow channels are defined between respective adjacent protruding helical fins of an array of protruding helical fins, wherein the array of protruding helical fins is integrally formed on the outer surface of the liner;

a plurality of fuel nozzles, wherein at least two fuel nozzles of the plurality of fuel nozzles are each respectively disposed at predetermined axial locations within at least two respective flow channels of the plurality of flow channels, thereby defining at least two respective flow path lengths between each of the at least two fuel nozzles and a combustion chamber; and wherein the at least two respective flow path lengths comprise at least two different flow path lengths.

7. A combustor comprising:

a combustion chamber;

an external flow sleeve;

a combustor liner surrounding the combustion chamber and coupled to the external flow sleeve, wherein the combustor liner comprises an array of protruding helical fins;

a plurality of flow channels, wherein each flow channel of the plurality of flow channels is defined between respective adjacent protruding helical fins of the array of protruding helical fins, and wherein the plurality of protruding helical fins are formed on an outer surface of the combustor liner;

a plurality of fuel nozzles;

wherein at least one flow channel of the plurality of flow channels has at least one fuel nozzle of the plurality of fuel nozzles disposed at a predetermined axial location and wherein the predetermined axial location is selected to provide a first flow path length between the at least one fuel nozzle and the combustion chamber which is different than a second flow path length between at least one other fuel nozzle of the plurality of fuel nozzles, disposed at a second predetermined axial location within at least one other flow channel of the plurality of flow channels, and the combustion chamber.

8. The combustor of claim 7 wherein the plurality of fuel nozzles comprises at least three fuel nozzles.

9. The combustor of claim 8 wherein the plurality of flow channels are adapted to convey a stream of fluid.

10. The combustor of claim 7 wherein the plurality of flow channels are divided into at least two sections, each of the at least two sections independently receiving fuel from at least one respective fuel nozzle of the plurality of fuel nozzles.

11. The combustor of claim 7 wherein the combustor has a longitudinal axis and the combustor further comprises a dome assembly comprising a central nozzle that injects a mixture of fuel and oxidizing fluid along the longitudinal axis of the combustor.

12. The combustor of claim 7 further comprising at least one damper disposed adjacent to the external flow sleeve.

13. A gas turbine comprising:

a combustor comprising:

a combustion chamber;

an external flow sleeve;

an array of protruding helical fins;

a combustor liner surrounding the combustion chamber and coupled to the external flow sleeve;

a plurality of flow channels between the combustor liner and the external flow sleeve, wherein each flow channel of the plurality of flow channels is defined between respective adjacent protruding helical fins of the array of protruding helical fins, and wherein the plurality of protruding helical fins are formed on an outer surface of the combustor liner; and a plurality of fuel nozzles;

wherein at least two flow channels of the plurality of flow channels each have at least one respective fuel nozzle of the plurality of fuel nozzles disposed at respective axial locations therein, wherein respective flow path lengths between each at least one respective fuel nozzle and the combustion chamber are different.

14. The gas turbine of claim 13 wherein the combustion chamber has a longitudinal axis and the combustor further comprises a dome assembly having a central nozzle that injects a mixture of fuel and oxidizing fluid along the longitudinal axis of the combustion chamber.

15. The gas turbine of claim 14 wherein the central nozzle has a plurality of injection channels having different lengths.

16. The gas turbine of claim 14 further comprising at least one liquid fuel nozzle disposed adjacent to the central nozzle.

17. The gas turbine of claim 13 wherein the plurality of flow channels are divided into at least two sections, each of the at least two sections independently receiving a fuel.

* * * * *